US009327249B2

(12) United States Patent
Albro et al.

(10) Patent No.: US 9,327,249 B2
(45) Date of Patent: May 3, 2016

(54) SYSTEMS AND METHODS FOR HUMIDIFYING GAS STREAMS

(75) Inventors: Robert Scott Albro, Zionsville, PA (US); Anna K. Wehr-Aukland, Macungie, PA (US); John Lewis Green, Palmerton, PA (US); Donald James Bowe, Zionsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 837 days.

(21) Appl. No.: 13/448,613

(22) Filed: Apr. 17, 2012

(65) Prior Publication Data

US 2013/0270724 A1 Oct. 17, 2013

(51) Int. Cl.

| | |
|---|---|
| ***B01F 3/04*** | (2006.01) |
| ***B01F 3/22*** | (2006.01) |
| ***B01F 15/00*** | (2006.01) |
| ***B01F 3/02*** | (2006.01) |

(52) U.S. Cl.

CPC ..... *B01F 3/04007* (2013.01); *B01F 3/022* (2013.01); *B01F 3/028* (2013.01); *B01F 3/2215* (2013.01); *B01F 15/0024* (2013.01)

(58) Field of Classification Search

CPC .... B01F 3/04007; B01F 3/2215; B01F 3/028; B01F 3/022; B01F 15/0024

USPC ..... 261/128, 130, 140.1, 152, 119.1

See application file for complete search history.

(56) References Cited

U.S. PATENT DOCUMENTS

| | | | | |
|---|---|---|---|---|
| 2,342,689 | A * | 2/1944 | Pennington | 62/91 |
| 2,710,178 | A * | 6/1955 | Froelich | 261/119.1 |
| 3,665,748 | A | 5/1972 | Mator | |
| 3,854,909 | A * | 12/1974 | Hoisington et al. | 96/327 |
| 3,894,419 | A | 7/1975 | Mator et al. | |
| 4,152,379 | A * | 5/1979 | Suhr | 261/142 |
| 4,450,118 | A * | 5/1984 | Tuin | 261/147 |
| 4,528,147 | A | 7/1985 | Ilgner et al. | |
| 5,058,227 | A * | 10/1991 | Schoenfelder | 5/658 |
| 5,348,592 | A | 9/1994 | Garg et al. | |
| 5,531,372 | A | 7/1996 | Bonner et al. | |
| 5,613,185 | A * | 3/1997 | Marsden et al. | 419/58 |
| 6,123,324 | A | 9/2000 | Swan et al. | |
| 6,526,803 | B1 | 3/2003 | Fraenkel et al. | |

(Continued)

FOREIGN PATENT DOCUMENTS

| | | |
|---|---|---|
| EP | 0105089 A1 | 4/1984 |
| EP | 0 704 273 A1 | 4/1996 |

(Continued)

*Primary Examiner* — Charles Bushey
(74) *Attorney, Agent, or Firm* — Amy Carr-Trexler

(57) ABSTRACT

Systems and methods are provided for humidifying a gas stream. Methods for providing a humidified gas stream comprise providing a dry gas, directing the dry gas to a humidification device, humidifying the dry gas to provide a humidified gas stream having an amount of moisture in excess of a predetermined amount, directing the humidified gas stream to a cooling device, cooling the humidified gas to a predetermined temperature, and directing the cooled humidified gas to a point of usage. Systems for providing a humidified gas stream comprise a dry gas stream, a humidification device configured to receive and humidify the dry gas stream to form a humidified gas stream having an amount of moisture in excess of a predetermined amount, and a cooling device configured to receive and cool the humidified gas stream to a predetermined temperature to form a cooled humidified gas stream.

13 Claims, 4 Drawing Sheets

(56) References Cited

U.S. PATENT DOCUMENTS

| | | | | |
|---|---|---|---|---|
| 6,863,268 | B2 * | 3/2005 | Zhang | 261/130 |
| 7,395,673 | B2 * | 7/2008 | Mitter | 62/176.1 |
| 7,618,027 | B2 * | 11/2009 | Spiegelman | 261/130 |
| 2002/0015867 | A1 * | 2/2002 | Cargnelli et al. | 429/13 |
| 2003/0098516 | A1 * | 5/2003 | Zhang | 261/127 |
| 2010/0201006 | A1 | 8/2010 | Lee et al. | |
| 2011/0318216 | A1 | 12/2011 | Bowe et al. | |

FOREIGN PATENT DOCUMENTS

| | | | |
|---|---|---|---|
| EP | 2 218 496 | A1 | 8/2010 |
| JP | 2008275185 | A2 | 11/2008 |
| WO | 2012013324 | A2 | 2/2012 |

* cited by examiner

SYSTEMS AND METHODS FOR HUMIDIFYING GAS STREAMS

BACKGROUND OF THE INVENTION

The present invention provides systems and methods for producing a humidified gas stream with a precisely controlled moisture content.

Humidified gases such as nitrogen, non-cryogenically generated nitrogen, hydrogen, air, oxygen-enriched air, carbon dioxide, argon, helium, and mixtures thereof are widely employed by chemical, thermal, metallurgical, electronics, laser processing, fuel cells, and food processing industries to enhance chemical reactions, weld and spray metallic and ceramic materials by thermal and plasma techniques, braze and sinter metallic components, refine ferrous and nonferrous metals and metal alloys, enhance combustion, provide desired physical and mechanical properties to metals and metal alloys, solder electronic components, deposit oxides of various elements by chemical vapor and physical vapor deposition techniques, control composition of gases used in lasers, manipulate composition of gases used in fuel cells, enhance shelf life of perishable food items such as vegetables and fruits, and package food stuffs. Humidified gases are also used to control the environment and adjust comfort level for humans such as by producing and supplying synthetic breathable atmospheres and medicinal gases.

Numerous techniques have been employed to humidify gases with some type of humidity control. For example, a gas stream is split into two separate streams; one passing through a humidifier and the other by-passing the humidifier. The two streams are then combined and the humidity level of the combined stream is measured, such as by a relative humidity measuring instrument. The humidity level of the combined stream is then controlled either by regulating the flow rate of the gas stream passing through the humidifier or by regulating the flow rate of the gas stream by-passing the humidifier. Alternatively, gas streams are humidified simply by adding steam and regulating the humidity level by the extent of steam addition. Although these techniques provide some level of humidity control and are suitable for many applications (such as environmental, food-processing, and combustion related applications), they fail to provide the precise control of humidity that is required in many chemical, thermal, metallurgical, and electronics applications. Furthermore, they are not suitable for precisely humidifying gases with low humidity, such as those having less than 2,000 ppm of moisture in the gas stream, or with a dew point less than about −13° C. at ambient temperature and pressure.

One such application requiring precise humidification of gases with low humidity is for use in continuous sintering furnaces having stainless steel belts that break down over time due to reduction of the belt material in the heating zone of the furnace. It has been found that the service life of belts used in such furnaces can be extended by providing a controlled amount of moisture such that the atmosphere within the furnace is oxidizing to the belt material, thus forming a protective oxide layer on the belt, but reducing to metal components being sintered in the furnace. See, for example, U.S. Pat. No. 5,613,185, which describes adding an oxidizing agent such as moisture, carbon dioxide, nitrous oxide, etc.) to atmospheres comprising nitrogen and hydrogen to more than double belt life in sintering furnaces. A similar approach is taken in U.S. Patent Application Publication No. 2011/0318216, which describes the addition of from about 1 to about 10 vol % endothermic gas ("endo-gas") to an atmosphere comprising nitrogen and hydrogen in order to form an atmosphere that is oxidizing to belt material but reducing to metal parts in a sintering furnace.

A further humidification technique is set forth in U.S. Pat. No. 6,123,324, which describes introducing a controlled amount of water through a metering device into a gas-liquid contactor packed with inert non-porous packing material, introducing a known and precise flow rate of gas into the contactor, and shearing and vaporizing the water stream with the gas stream in the contactor. While the process provides a precise amount of moisture, it requires careful control of the amount of water added and specialized equipment that is operated under pressure. Additional humidification techniques are described in patent applications WO 2012/013324 and JP 2008-275185.

Gases have been humidified with a known amount of moisture without relying on humidity measuring devices by bubbling them through water in a bubble-type humidifier, or "bubbler." The moisture content of the gas stream humidified by passing through a bubbler is calculated from the operating conditions such as water temperature and total pressure of the bubbler. For example, the vapor pressure of water or moisture in the gas stream is determined from the water temperature. The vapor pressure of water and total operating pressure information is then used to calculate partial pressure of water or moisture content in the gas stream. The above calculation inherently assumes that the gas stream is saturated with moisture. If the gas stream is not saturated with moisture, then the calculated moisture content value will always be higher than the real moisture content in the gas stream. This is the main reason that bubblers are seldom used in applications requiring precise, consistent and reliable humidity levels.

Numerous changes in the design of bubblers have been made over the years to provide precise, consistent and reliable humidity level in gases. These improvements have been focused toward improving gas-liquid contact and maintaining constant water level and water temperature in the bubbler. Some of the new bubbler designs do provide a humidified gas stream with precise, consistent and reliable humidity levels, provided flow rate of the gas stream is maintained constant. Therefore, bubblers are sized and designed to provide a fixed flow rate of a humidified gas stream. They, however, fail to humidify a gas stream with precise, consistent and reliable humidity level if the flow rate of the humidified gas stream changes with time or if the moisture level requirement in the humidified gas stream changes with time.

Based on the above discussion, it is clear that there is a need for a system to humidify gases with a precise, consistent, and reliable amount of moisture without relying on complex measuring devices or expensive materials and equipment.

BRIEF SUMMARY OF THE INVENTION

The present invention provides systems and methods for humidifying a gas stream with a precise, consistent, and reliable amount of moisture. Gas streams humidified in accordance with the present invention are useful in a variety of applications, including but not limited to, annealing, brazing, and sintering of metals and alloys, reflow soldering of electronic components, glass-to-metal sealing, chemical processes, chemical vapor deposition of metal oxides, laser processing, fuel cells, etc.

In some embodiments of the present invention, methods for providing a humidified gas stream to a point of usage comprise providing a stream of dry gas, directing at least a portion of the dry gas stream to a humidification device, humidifying the at least a portion of the dry gas stream to provide a humidified gas stream having an amount of moisture in excess of a predetermined amount, directing the humidified gas stream to a cooling device, cooling the humidified gas to a predetermined temperature, and directing the cooled humidified gas to the point of usage. As used herein, a "dry" gas stream is one having less than or equal to 10 ppm moisture. In additional embodiments of the present invention, systems for providing a humidified gas stream to a point of usage comprise a dry gas stream, a humidification device configured to receive at least a portion of the dry gas stream and humidify the at least a portion of the dry gas stream to form a humidified gas stream having an amount of moisture in excess of a predetermined amount, and a cooling device configured to receive the humidified gas stream and cool it to a predetermined temperature to form a cooled humidified gas stream.

In at least some of the foregoing embodiments, the predetermined amount of moisture is the amount of moisture (such as water vapor) required to increase the dew point at the point of usage (such as in a furnace) to a desired dew point. In this manner, dry gas is humidified to excess in a simple, commercially available humidification device and thereafter cooled to a precise temperature so that the excess moisture in the humidified gas condenses and is removed, resulting in a humidified gas stream having a known and easily controlled amount of moisture that is attained in a cost-effective manner and without requiring precise control of the amount of moisture added to the dry gas in the humidification device.

In one or more embodiments of the present invention, the dry gas comprises nitrogen, the moisture is water vapor, and the point of usage is a continuous sintering furnace having a steel conveyor belt. In such embodiments, the water vapor supplied by the humidified nitrogen is sufficient to increase the dew point within the furnace to a point where the atmosphere is oxidizing to the belt but reducing to metal parts being sintered in the furnace, thereby extending the service life of the belt, such as from about −35° C. to about −45° C.

DETAILED DESCRIPTION OF THE INVENTION

Figure 1:
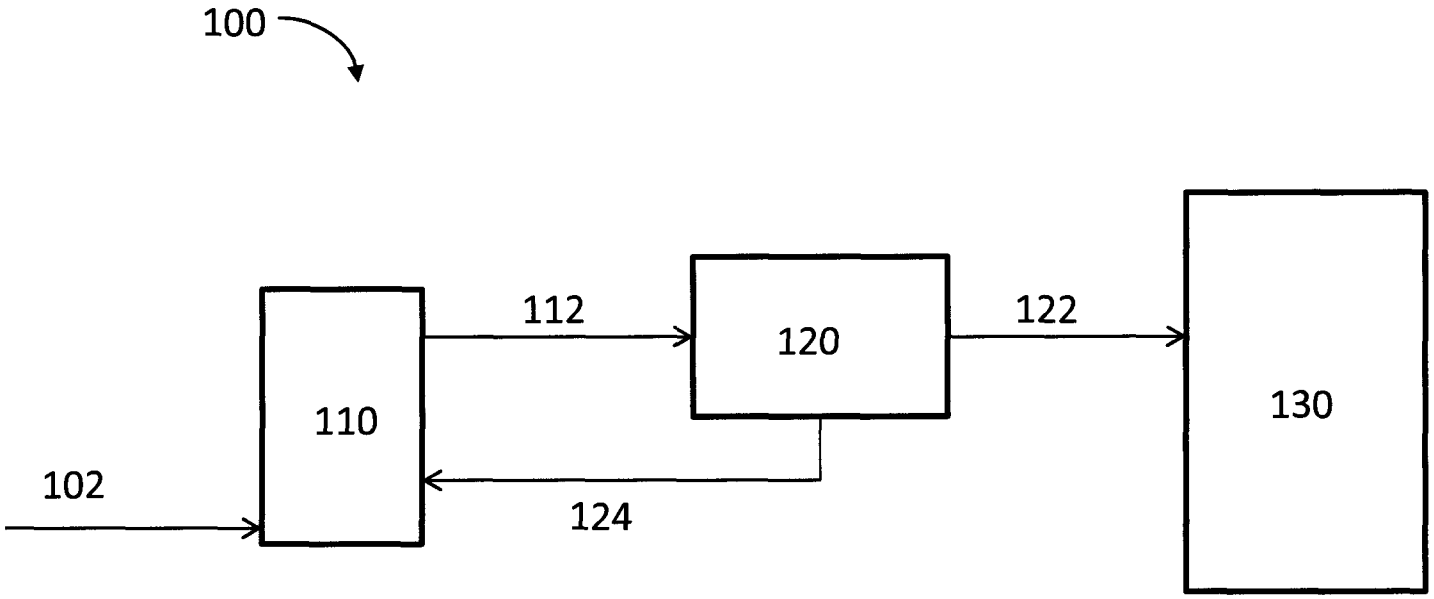
FIG. 1 is a schematic diagram of a first exemplary embodiment of the invention, in which a gas stream is humidified.

To aid in describing the invention, directional terms may be used in the specification and claims to describe portions of the present invention (e.g., upper, lower, left, right, etc.). These directional terms are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

Humidified gases such as nitrogen, non-cryogenically generated nitrogen, hydrogen, air, oxygen-enriched air, carbon dioxide, argon, helium, and mixtures thereof are widely employed by chemical, thermal, metallurgical, electronics, laser processing, fuel cells, and food processing industries to enhance chemical reactions, weld and spray metallic and ceramic materials by thermal and plasma techniques, braze and sinter metallic components, refine ferrous and nonferrous metals and metal alloys, enhance combustion, provide desired physical and mechanical properties to metals and metal alloys, solder electronic components, deposit oxides of various elements by chemical vapor and physical vapor deposition techniques, control composition of gases used in lasers, manipulate composition of gases used in fuel cells, enhance shelf life of perishable food items such as vegetables and fruits, and package food stuffs. Humidified gases are also used to control the environment and adjust comfort level for humans such as by producing and supplying synthetic breathable atmospheres and medicinal gases.

Humidified gases produced in accordance with the present invention are especially suited for use in situations requiring comparatively low and accurate amounts of moisture in the gas provided to a point of usage, such as in continuous furnaces, where the addition of water vapor creates an atmosphere that extends the service life of conveyor belts used in the furnace. In these situations, the systems and methods of the present invention have many benefits, which include cost efficiency, ease of installation, the use of commercially available components, no minimum required amount of moisture added, and no required heating in the humidifier or the gas line.

Methods of the present invention are directed to providing a humidified gas stream to a point of usage. According to one or more embodiments, a gas stream is provided and at least a portion of the gas stream is humidified to excess in a humidification device. The humidified gas stream is then cooled in a cooling device to a predetermined temperature and delivered to the point of usage. The phrase "humidified to excess" means that the gas is humidified to a point at which it comprises an amount of moisture greater than a predetermined amount. In most cases, the predetermined amount of moisture will be the amount required to achieve and maintain the desired dew point at the point of usage, and the gas is humidified in the humidification device to such an extent that it comprises more than that predetermined amount of moisture. The required amount of moisture can be readily calculated based upon the total gas flow to the point of usage, the starting dew point at the point of usage, and the desired dew point at the point of usage. The process used to humidify the gas does not need to be precise so long as the gas is humidified to excess, which allows for the use of a humidification device that is simpler and more cost effective than many previous systems.

In some embodiments of the present invention, the predetermined amount of moisture is the amount required to achieve a dew point at the point of usage within the range of from −60° C. to +90° C., such as a dew point within the range from −30 to −50° C., or from −35 to −45° C., or from −25 to 0° C., or from −20 to +10° C., or from −20 to +30° C., or from 0 to 30° C., or from 5 to 25° C., or from 40 to 70° C., or from 50 to 60° C. In the same or other embodiments of the invention, the predetermined amount of moisture is the amount required to raise the dew point at the point of usage by at least 5° C., or by at least 10° C., or by at least 15° C.

Once the gas stream is humidified to excess, the humidified stream is cooled to a predetermined temperature using a cooling device. The predetermined temperature should be lower than the temperature of the humidified gas exiting the humidification device and is the dew point at which excess moisture in the gas condenses, resulting in a cooled humidified gas having precisely the amount of moisture required to achieve and maintain the desired dew point at the point of usage. Any cooling device that maintains a constant and accurate temperature of the resulting cooled humidified gas stream may be used. The total amount of moisture delivered by the cooled humidified gas stream to the point of usage depends upon the volumetric flow rate of the gas stream and the temperature to which it is cooled. Accordingly, the amount of moisture provided in the systems and methods described herein can be readily adjusted by changing the flow rate of the gas stream entering the humidification device or by changing the temperature to which the humidified gas stream is cooled in the cooling device. In some embodiments of the invention, both the flow rate and the cooling temperature may be adjusted.

In one or more embodiments of the present invention, only a portion of the gas stream is humidified. In such embodiments, a slip stream of gas is diverted from a main gas stream, and the slip stream is directed to the humidification and cooling devices as described above. The cooled humidified slip stream is then returned to the main gas stream downstream of the cooling device, and the resulting mixed gas stream is directed to the point of usage. In embodiments where a slip stream is employed, the amount of moisture provided to the point of usage is adjusted by changing the flow rate of the slip stream and/or the temperature to which the humidified slip stream is cooled.

Referring to the appended figures, embodiments of the present invention is presented in FIGS. 1 through 4. It should be noted that the figures are simplified flow diagrams and, in some instances, do not show various pieces of auxiliary equipment, such as pumps, compressors, heat exchangers, and valves. Because one having ordinary skill in the art would recognize easily the need for and location of such auxiliary equipment, its omission is appropriate and facilitates the simplification of the figures.

FIG. 1 is a schematic diagram of an embodiment of the present invention exemplified by system 100. In system 100, a dry gas stream 102 is provided. At least a portion of dry gas stream 102 is directed to a humidification device 110. Within the humidification device 110, moisture is added to the at least a portion of dry gas stream 102, resulting in humidified gas stream 112, which exits the humidification device and is directed to a cooling device 120. Within the cooling device, the humidified gas stream 112 is cooled to a predetermined temperature, resulting in cooled humidified gas stream 122. Optionally, liquid that condenses out of the humidified gas stream as a result of cooling may be recycled from the cooling device to the humidification device via recycle liquid stream 124. Alternately, the condensed liquid may be collected and used for a variety of other applications. Upon exiting the cooling device 120, cooled humidified gas stream 122 is then directed to the point of usage 130. As described above, at least a portion of dry gas stream 102 is humidified via humidification device 110 to excess. In other words, the amount of moisture required to be delivered to the point of usage 130 for an intended application is predetermined and dry gas stream 102 is humidified to a point such that the amount of moisture in the gas is more than the predetermined amount required. The amount of moisture added to dry gas stream 102 by the humidification device 110 need not be accurate or stable, so long as it exceeds the predetermined amount of moisture required.

Any carrier gas suitable for the desired application and point of usage may be employed in the systems and methods described herein. Exemplary carrier gases may comprise, but are not limited to, nitrogen, non-cryogenically generated nitrogen, hydrogen, air, oxygen-enriched air, carbon dioxide, argon, helium, and mixtures thereof. In one or more embodiments of the invention, the gas comprises nitrogen. In the same or other embodiments, the gas comprises nitrogen and from about 1 to about 15 vol %, or from about 2 to about 10 vol %, or from about 3 to about 7 vol % of a reducing gas such as hydrogen. Where a blend of hydrogen and nitrogen is used, it may be preferable for safety reasons to humidify only the nitrogen and add the desired amount of hydrogen to the system separately. In such cases, the hydrogen may be added at any location within the system such that it is mixed with the nitrogen after the nitrogen has been humidified and cooled but upstream of the point of usage.

In one or more embodiments, the liquid used to supply moisture to the dry gas comprises water. Depending upon the requirements at the point of usage, the liquid may be heated if necessary to provide the required amount of moisture to the carrier gas. For applications requiring a relatively low amount of moisture and at ambient temperature and pressure, however, a benefit of the systems and methods of the present invention is that the required amount of moisture can be added to the gas without requiring the addition of heat.

Any humidification device capable of humidifying a gas stream to excess at the temperature and pressure of the system and the flow rate required by the point of usage is suitable for use in the systems and methods of the present invention. Advantageously, because the gas stream is humidified to excess and the exact amount of moisture added does not need to be precisely controlled, commercially available (and relatively inexpensive) humidification devices may be employed. Humidification devices are generally available commercially that are capable of humidifying gas streams (such as, for example, a gas stream having a flow rate of about 20 standard cubic feet per hour) to a wide range of dew points, such as from about −60° C. to about +90° C.

In some embodiments, the humidification device is one in which the gas stream to be humidified is passed through a liquid bath, such as a bubble-type humidifier. In such embodiments, dry gas is bubbled through the liquid so as to increase the interface between the liquid and the gas. As the dry gas contacts the liquid, the dry gas adsorbs the liquid in vapor form. As the humidified gas leaves the liquid bath, it is near the saturation point of the liquid vapor in the gas, and any gross moisture that is not adsorbed in the gas is knocked out of the gas stream by directional changes and returns to the liquid bath. Exemplary bubble humidifiers are available commercially in a variety of sizes and from a variety of manufacturers. In some embodiments of the invention, the humidification device is a bubble humidifier having a capacity from about 0.5 to about 10 gallons, or from about 1 to about 5 gallons, or from about 2 to about 4 gallons.

In one or more embodiments of the invention, the humidification device operates at ambient temperature and pressure, with little to no pressure change across the humidification device. For example, in some embodiments the pressure change across the humidification device is less than 3 psig, or less than 2 psig, or less than 1 psig. Because the moisture concentration (for example water vapor concentration) in the humidified gas depends upon its temperature and pressure, when the humidification device operates at atmospheric pressure with minimal change in pressure there is no effect of pressure on the system. In such embodiments, the systems and methods of the present invention provide additional ease of use and control because there is no need to measure or adjust the pressure of the gas stream or the pressure within the humidification device during operation. In other embodiments, however, it may be desirable to periodically check and adjust the pressure of the gas prior to humidification to ensure that it is substantially equivalent to the pressure at the point of usage. As used herein, "substantially equivalent" means that the pressure of the gas prior to humidification is within 5%, preferably within 3%, preferably within 1% of the pressure at the point of usage.

Any cooling device capable of cooling a humidified gas stream to a precise and stable temperature is suitable for use in the systems and methods described herein. Such cooling units are available commercially, and include but are not limited to refrigerators and sample gas coolers. In one or more embodiments of the invention, the cooling device is a sample gas cooler. Exemplary sample gas coolers are available from, for example, Buhler Technologies LLC.

The humidification systems and methods described herein can be used to supply humidified gases to a variety of points of usage for many applications, because they can be configured to provide comparatively large or small amounts of moisture depending upon the requirements of a given point of usage. For example, in addition to extending belt service life in continuous furnaces by enabling the formation of a protective oxide layer as described above, the humidification systems and methods of the invention may be used in other processes requiring an increase in the dew point of the atmosphere such as brazing, decarburization and oxidation of steel components, and manufacture of glass-to-metal seals. Other exemplary applications include, but are not limited to, delubrication in powdered metal sintering, hydrocarbon removal in paste-based furnace brazing, hydrocarbon removal from rolling or stamping operations, decarburization and/or annealing of electrical steel strips and laminations, oxide coating of electrical laminations, oxide coating or stream treating of powdered metal components, black oxide coating of structural parts for rust prevention or cosmetic finishes, oxide coating of steel strips to prevent sticking between layers, controlled oxidizing atmospheres for matched and compression glass-to-metal sealing, oxidation control in aluminum powder atomization and storage, controlling surface finish of galvanized steel and controlling zinc fumes, sintering ceramic materials, and production of ferrite carbon brushes. For processes requiring comparatively high moisture addition, the humidification device and cooling device employed should be selected accordingly to accommodate a higher gas flow rate and more unstable cooling conditions. When the vapor concentration required in the humidified gas reaches or exceeds the saturation level at ambient temperatures, heating or insulation of the humidified gas line may also be required to prevent condensation.

The required dew point at the point of usage varies for the foregoing applications, and can be readily determined by those skilled in the art. For example, a dew point from about +4 to about +21° C. may desirable for delubrication applications, a dew point from about −17 to +4° C. may be desirable for matched glass-to-metal sealing applications, a dew point from about −23 to about −6° C. may be desirable for compression glass-to-metal sealing applications, a dew point of about +15 to about +18° C. may be desirable for degassing or decarburization, a dew point from about +50 to about +60° C. may be desirable for oxidation applications, and saturation may be desirable for black oxide coating applications. Further, the total gas flow to the point of usage will also vary widely, and can also be readily determined by those skilled in the art. For example, in continuous, open-ended belt furnaces, a total gas flow rate of about 75 to about 100 cubic feet per hour per inch of belt width may be desirable, while for batch type furnaces a flow rate equivalent to about 2 to 3 volume changes per hour may be desirable.

Figure 2:
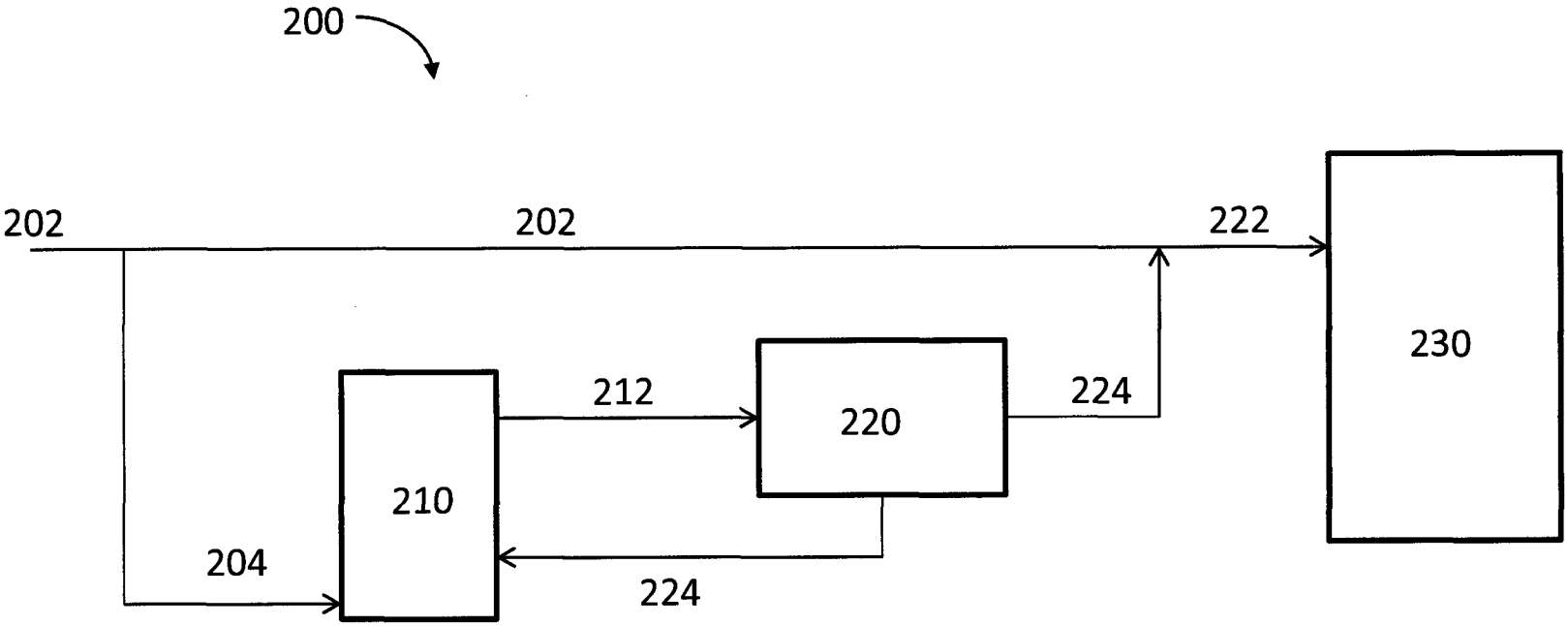
FIG. 2 is a schematic diagram of a second exemplary embodiment of the invention, in which a slip stream is diverted from a gas stream and the slip stream is humidified.
Figure 3:
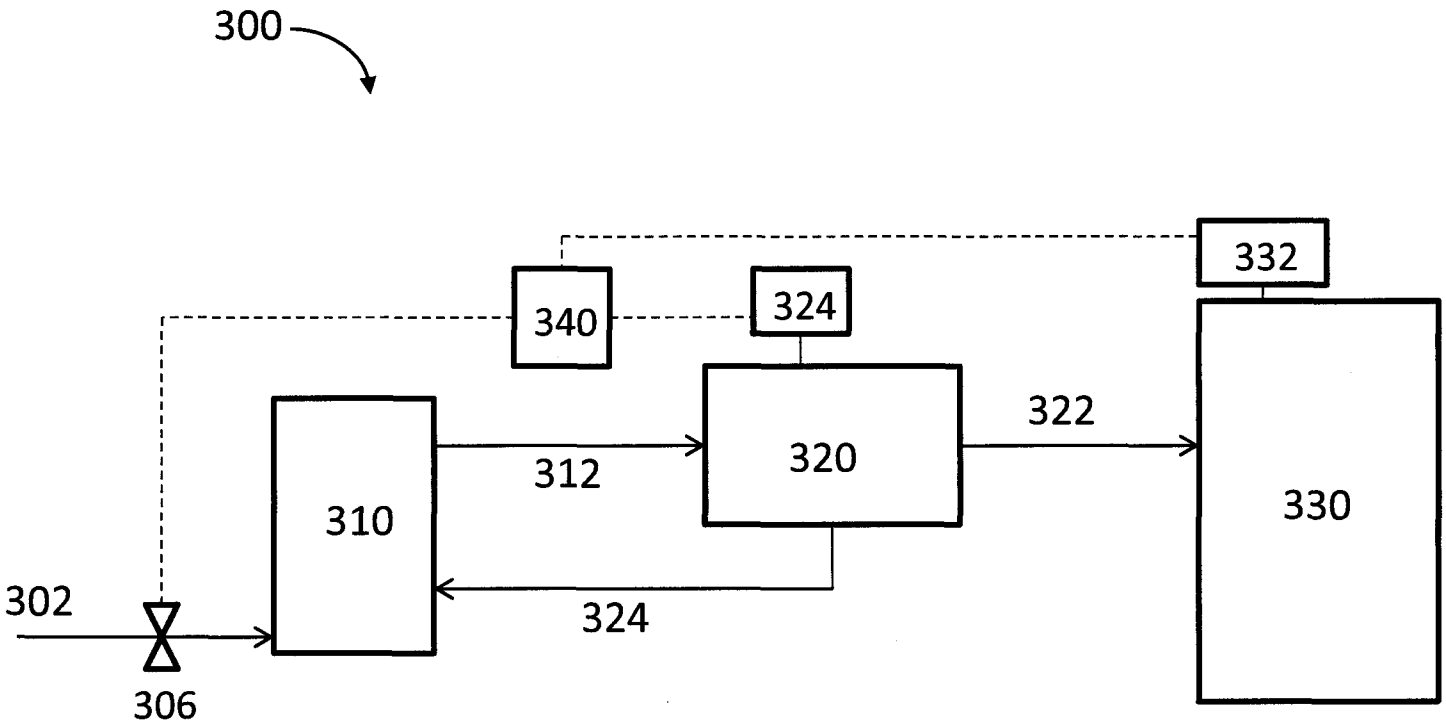
FIG. 3 is a schematic diagram of a third exemplary embodiment of the invention, in which either the flow of a gas stream or the temperature of a cooling unit, or both, are adjusted based on feedback from a point of usage.
Figure 4:
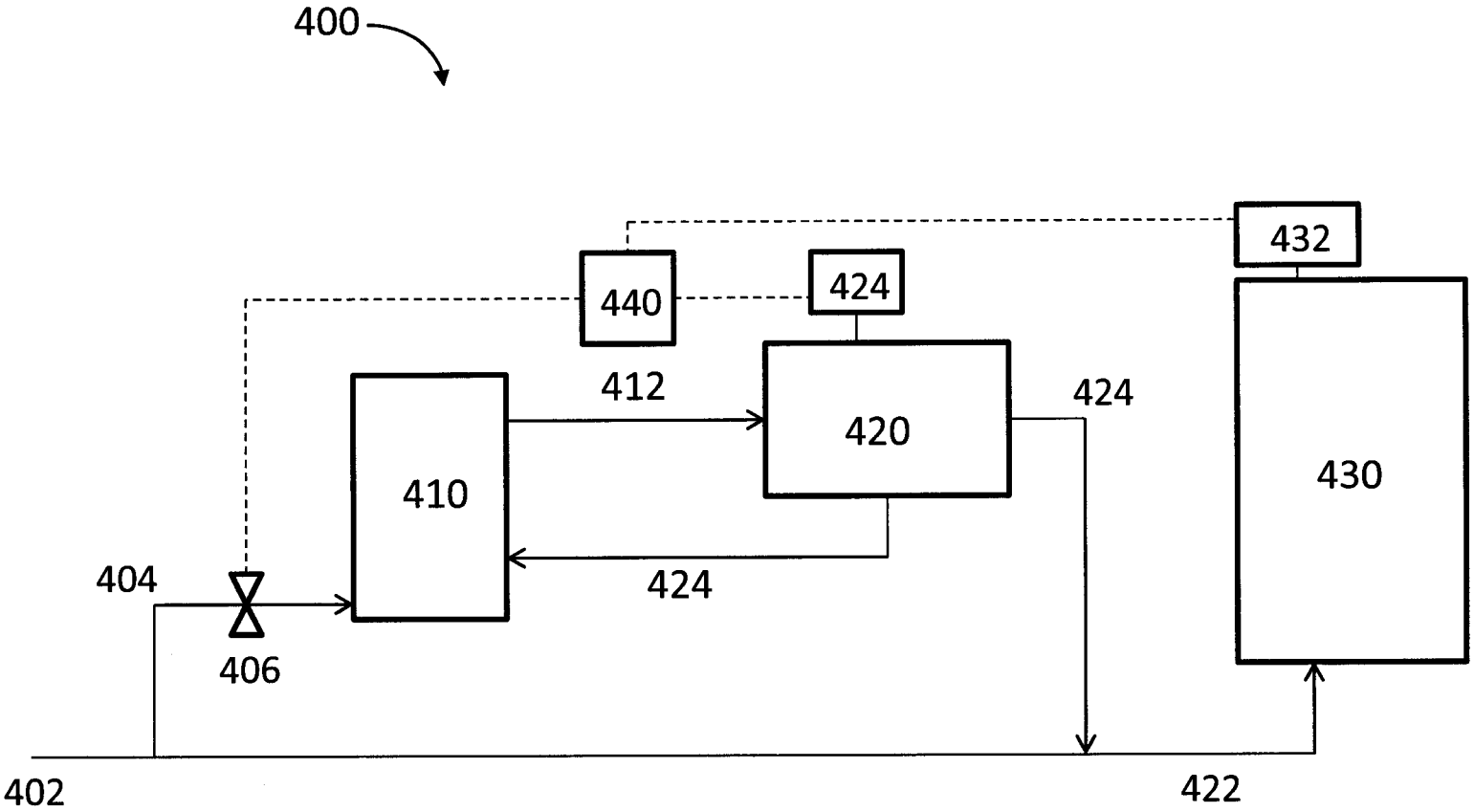
FIG. 4 is a schematic diagram of a fourth exemplary embodiment of the invention, in which a slip stream is diverted from a gas stream and the slip stream is humidified and either the flow of the slip stream or the temperature of a cooling unit, or both, are adjusted based on feedback from a point of usage.

Referring again to the figures, FIGS. 2 through 4 are schematic diagrams of embodiments of the present invention that are best understood with reference to system 100 depicted in FIG. 1. In these embodiments, elements of the system that are the same as elements in system 100 are given a reference numeral increased by 100 for each successive figure. For example, the humidification device 110 of system 100 is the same as the humidification device 210 of system 200 (FIG. 2), the humidification device 310 of system 300 (FIG. 3), and the humidification device 410 of system 400 (FIG. 4). In the interest of clarity, some features of these additional embodiments that are shared with the first embodiment are numbered in FIGS. 2 through 4 but are not repeated in the specification.

FIG. 2 is a schematic diagram of an embodiment of the present invention exemplified by system 200. In system 200, a portion of dry gas stream 202 is diverted as slip stream 204. Slip stream 204 is directed to the humidification device 210 and is humidified and cooled as described previously with reference to FIG. 1. Upon exiting the cooling device 220, the cooled humidified slip stream 224 is then combined with gas stream 202 to form mixed gas stream 222. Mixed gas stream 222 is then directed to the point of usage 230. The cooled humidified slip stream may be rejoined with gas stream 202 in any manner designed to incorporate the two streams into one, such as by a T-shaped junction, a Y-shaped junction, or by directing both streams 202 and 224 to a gas mixing device (not shown) and mixing the streams therein to form mixed gas stream 222. As will be recognized by those skilled in the art, the volume and flow rate of slip stream 204 should be chosen, in conjunction with the cooling temperature, to ensure that the amount of moisture added in the humidification and cooling steps is sufficient to adjust the dew point at the point of usage to the desired level.

For example, one application for the systems and methods described herein is to humidify the atmosphere in a continuous furnace so as to create an oxidizing environment and, in turn, increase the service life of belts used in the furnace. In such applications, achieving an oxidizing environment requires maintaining the dew point within the furnace at a temperature within the range of about −35° C. to about −45° C., preferably within the range of about −37.5° C. to about −42.5° C., such as about −40° C. For a total dry gas flow from about 1500 to about 2500 standard cubic feet per hour (scfh), then, the amount of moisture required to maintain a dew point within that range can be delivered via a slip stream having a flow rate from about 12 to about 20 scfh that is humidified and subsequently cooled in a cooling device having a setpoint within the range from about 7 to about 13° C.

In certain embodiments, the systems and methods of the present invention may be controlled via a closed-loop, in which the moisture concentration (dew point or humidity level) at the point of usage is measured and either the flow rate of the humidified gas stream or the temperature to which the humidified gas stream is cooled is adjusted based upon the measured moisture concentration. In some embodiments, both the flow rate and the temperature setpoint of the cooling device may be adjusted based upon the measured moisture concentration. In any of the foregoing embodiments, the desired moisture concentration at the point of usage will be known, and the steps of measuring the actual moisture concentration and adjusting the gas flow rate and/or cooling temperature may be repeated until the desired moisture concentration and the measured (actual) moisture concentration are the same or substantially the same. As used herein, "substantially the same" means that the desired concentration and actual concentration are within 5%, preferably within 3%, more preferably within 1% of one another. FIGS. 3 and 4 illustrate embodiments of the present invention employing closed-loop control.

FIG. 3 is a schematic diagram of an embodiment of the present invention exemplified by system 300. In system 300, an analyzer 332 measures moisture concentration (i.e., the dew point or humidity) at the point of usage 330. The analyzer transmits the measured moisture concentration to an analyzer indicator controller (AIC) 340. The AIC 340 then either adjusts control valve 306, thereby adjusting the flow rate of the dry gas stream 302, or adjusts the temperature setpoint of the cooling device 320 via temperature controller 324. Alternately, the AIC 340 may adjust both the flow rate of the dry gas stream 302 and the temperature setpoint of the cooling device 320 via control valve 306 and temperature controller 324, respectively.

FIG. 4 is a schematic diagram of an embodiment of the present invention exemplified by system 400. The configuration of system 400 is similar to that of system 300, except that the AIC 440 either adjusts control valve 406, thereby adjusting the flow rate of slip stream 404, or adjusts the temperature setpoint of the cooling device 420 via temperature controller 424 (or both).

EXAMPLES

The amount of water vapor that must be added to a gas stream flowing into a sintering furnace to obtain a final dew point within the furnace of −40° C. was calculated based on total gas flows of 1600 and 2400 scfh and on initial dew points in the furnace ranging from −80 to −55° F. (−62.22 to −48.33° C.). The results of these calculations are reported in Table 1, below.

TABLE 1

| | | | | | | Flow of the Humidified $N_2$ (scfh) | | |
|---|---|---|---|---|---|---|---|---|
| Total Gas Flow (scfh) | Initial Dew Point within the Hot Zone of the Furnace (° C.) | Initial Partial Pressure of $H_2O$ inside the Furnace | Initial $H_2O$ Flow (scfh) | Final Partial Pressure of $H_2O$ inside the Furnace | $H_2O$ Addition (scfh) | Dew Point = 5° C. $p_{H2O}$ = 8.6428E−03 | Dew Point = 6° C. $p_{H2O}$ = 9.2641E−03 | Dew Point = 7° C. $p_{H2O}$ = 9.9244E−03 |
| 1600 | −62.22 | 7.89E−06 | 1.2626E−02 | 1.2748E−04 | 0.191 | 21.95 | 20.47 | 19.09 |
| 1600 | −61.67 | 8.52E−06 | 1.3633E−02 | 1.2748E−04 | 0.190 | 21.83 | 20.36 | 18.99 |
| 1600 | −61.11 | 9.20E−06 | 1.4714E−02 | 1.2748E−04 | 0.189 | 21.71 | 20.24 | 18.88 |
| 1600 | −60.56 | 9.92E−06 | 1.5875E−02 | 1.2748E−04 | 0.188 | 21.58 | 20.12 | 18.77 |
| 1600 | −60.00 | 1.07E−05 | 1.7120E−02 | 1.2748E−04 | 0.187 | 21.43 | 19.98 | 18.64 |
| 1600 | −59.44 | 1.15E−05 | 1.8456E−02 | 1.2748E−04 | 0.186 | 21.28 | 19.84 | 18.51 |
| 1600 | −58.89 | 1.24E−05 | 1.9888E−02 | 1.2748E−04 | 0.184 | 21.12 | 19.69 | 18.37 |
| 1600 | −58.33 | 1.34E−05 | 2.1422E−02 | 1.2748E−04 | 0.183 | 20.94 | 19.52 | 18.21 |
| 1600 | −57.78 | 1.44E−05 | 2.3067E−02 | 1.2748E−04 | 0.181 | 20.75 | 19.35 | 18.05 |
| 1600 | −57.22 | 1.55E−05 | 2.4829E−02 | 1.2748E−04 | 0.179 | 20.55 | 19.16 | 17.87 |
| 1600 | −56.67 | 1.67E−05 | 2.6714E−02 | 1.2748E−04 | 0.177 | 20.33 | 18.96 | 17.69 |
| 1600 | −56.11 | 1.80E−05 | 2.8731E−02 | 1.2748E−04 | 0.175 | 20.10 | 18.74 | 17.48 |
| 1600 | −55.56 | 1.93E−05 | 3.0890E−02 | 1.2748E−04 | 0.173 | 19.86 | 18.51 | 17.27 |
| 1600 | −55.00 | 2.07E−05 | 3.3198E−02 | 1.2748E−04 | 0.171 | 19.59 | 18.27 | 17.04 |
| 1600 | −54.44 | 2.23E−05 | 3.5667E−02 | 1.2748E−04 | 0.168 | 19.31 | 18.00 | 16.79 |
| 1600 | −53.89 | 2.39E−05 | 3.8304E−02 | 1.2748E−04 | 0.166 | 19.00 | 17.72 | 16.53 |
| 1600 | −53.33 | 2.57E−05 | 4.1122E−02 | 1.2748E−04 | 0.163 | 18.68 | 17.42 | 16.25 |
| 1600 | −52.78 | 2.76E−05 | 4.4131E−02 | 1.2748E−04 | 0.160 | 18.34 | 17.10 | 15.95 |
| 1600 | −52.22 | 2.96E−05 | 4.7342E−02 | 1.2748E−04 | 0.157 | 17.97 | 16.75 | 15.63 |
| 1600 | −51.67 | 3.17E−05 | 5.0771E−02 | 1.2748E−04 | 0.153 | 17.57 | 16.39 | 15.29 |
| 1600 | −51.11 | 3.40E−05 | 5.4427E−02 | 1.2748E−04 | 0.150 | 17.16 | 15.99 | 14.92 |
| 1600 | −50.56 | 3.65E−05 | 5.8328E−02 | 1.2748E−04 | 0.146 | 16.71 | 15.58 | 14.53 |
| 1600 | −50.00 | 3.91E−05 | 6.2486E−02 | 1.2748E−04 | 0.142 | 16.23 | 15.13 | 14.12 |
| 1600 | −49.44 | 4.18E−05 | 6.6917E−02 | 1.2748E−04 | 0.137 | 15.72 | 14.66 | 13.67 |
| 1600 | −48.89 | 4.48E−05 | 7.1638E−02 | 1.2748E−04 | 0.132 | 15.18 | 14.15 | 13.20 |
| 1600 | −48.33 | 4.79E−05 | 7.6666E−02 | 1.2748E−04 | 0.127 | 14.60 | 13.62 | 12.70 |
| 2400 | −62.22 | 7.89E−06 | 1.8939E−02 | 1.2748E−04 | 0.287 | 32.93 | 30.70 | 28.64 |
| 2400 | −61.67 | 8.52E−06 | 2.0449E−02 | 1.2748E−04 | 0.286 | 32.75 | 30.54 | 28.49 |
| 2400 | −61.11 | 9.20E−06 | 2.2071E−02 | 1.2748E−04 | 0.284 | 32.57 | 30.36 | 28.32 |
| 2400 | −60.56 | 9.92E−06 | 2.3812E−02 | 1.2748E−04 | 0.282 | 32.37 | 30.18 | 28.15 |
| 2400 | −60.00 | 1.07E−05 | 2.5680E−02 | 1.2748E−04 | 0.280 | 32.15 | 29.98 | 27.96 |
| 2400 | −59.44 | 1.15E−05 | 2.7684E−02 | 1.2748E−04 | 0.278 | 31.92 | 29.76 | 27.76 |
| 2400 | −58.89 | 1.24E−05 | 2.9832E−02 | 1.2748E−04 | 0.276 | 31.68 | 29.53 | 27.55 |
| 2400 | −58.33 | 1.34E−05 | 3.2134E−02 | 1.2748E−04 | 0.274 | 31.41 | 29.29 | 27.32 |
| 2400 | −57.78 | 1.44E−05 | 3.4601E−02 | 1.2748E−04 | 0.271 | 31.13 | 29.02 | 27.07 |
| 2400 | −57.22 | 1.55E−05 | 3.7243E−02 | 1.2748E−04 | 0.269 | 30.83 | 28.74 | 26.81 |
| 2400 | −56.67 | 1.67E−05 | 4.0070E−02 | 1.2748E−04 | 0.266 | 30.50 | 28.44 | 26.53 |
| 2400 | −56.11 | 1.80E−05 | 4.3097E−02 | 1.2748E−04 | 0.263 | 30.15 | 28.11 | 26.23 |
| 2400 | −55.56 | 1.93E−05 | 4.6334E−02 | 1.2748E−04 | 0.260 | 29.78 | 27.77 | 25.90 |
| 2400 | −55.00 | 2.07E−05 | 4.9798E−02 | 1.2748E−04 | 0.256 | 29.39 | 27.40 | 25.56 |
| 2400 | −54.44 | 2.23E−05 | 5.3501E−02 | 1.2748E−04 | 0.252 | 28.96 | 27.00 | 25.19 |
| 2400 | −53.89 | 2.39E−05 | 5.7456E−02 | 1.2748E−04 | 0.249 | 28.51 | 26.58 | 24.79 |
| 2400 | −53.33 | 2.57E−05 | 6.1682E−02 | 1.2748E−04 | 0.244 | 28.02 | 26.13 | 24.37 |
| 2400 | −52.78 | 2.76E−05 | 6.6197E−02 | 1.2748E−04 | 0.240 | 27.50 | 25.64 | 23.92 |
| 2400 | −52.22 | 2.96E−05 | 7.1014E−02 | 1.2748E−04 | 0.235 | 26.95 | 25.13 | 23.44 |
| 2400 | −51.67 | 3.17E−05 | 7.6157E−02 | 1.2748E−04 | 0.230 | 26.36 | 24.58 | 22.93 |

TABLE 1-continued

| | | | | | | | | |
|---|---|---|---|---|---|---|---|---|
| 2400 | −51.11 | 3.40E−05 | 8.1641E−02 | 1.2748E−04 | 0.224 | 25.73 | 23.99 | 22.38 |
| 2400 | −50.56 | 3.65E−05 | 8.7492E−02 | 1.2748E−04 | 0.218 | 25.06 | 23.37 | 21.80 |
| 2400 | −50.00 | 3.91E−05 | 9.3730E−02 | 1.2748E−04 | 0.212 | 24.35 | 22.70 | 21.17 |
| 2400 | −49.44 | 4.18E−05 | 1.0038E−01 | 1.2748E−04 | 0.206 | 23.58 | 21.99 | 20.51 |
| 2400 | −48.89 | 4.48E−05 | 1.0746E−01 | 1.2748E−04 | 0.199 | 22.77 | 21.23 | 19.80 |
| 2400 | −48.33 | 4.79E−05 | 1.1500E−01 | 1.2748E−04 | 0.191 | 21.91 | 20.42 | 19.05 |

| | Flow of the Humidified $N_2$ (scfh) | | | | | | | |
|---|---|---|---|---|---|---|---|---|
| Total Gas Flow (scfh) | Dew Point = 8° C. $P_{H2O}$ = 1.0626E−02 | Dew Point = 9° C. $P_{H2O}$ = 1.1371E−02 | Dew Point = 10° C. $P_{H2O}$ = 1.2161E−02 | Dew Point = 11° C. $P_{H2O}$ = 1.3000E−02 | Dew Point = 12° C. $P_{H2O}$ = 1.3889E−02 | Dew Point = 13° C. $P_{H2O}$ = 1.4831E−02 | Dew Point = 14° C. $P_{H2O}$ = 1.5829E−02 | Dew Point = 15° C. $P_{H2O}$ = 1.6885E−02 |
| 1600 | 17.82 | 16.64 | 15.54 | 14.53 | 13.59 | 12.71 | 11.90 | 11.14 |
| 1600 | 17.72 | 16.55 | 15.46 | 14.45 | 13.52 | 12.64 | 11.84 | 11.08 |
| 1600 | 17.62 | 16.46 | 15.38 | 14.37 | 13.44 | 12.57 | 11.77 | 11.02 |
| 1600 | 17.52 | 16.36 | 15.28 | 14.28 | 13.36 | 12.50 | 11.70 | 10.95 |
| 1600 | 17.40 | 16.25 | 15.18 | 14.19 | 13.27 | 12.41 | 11.62 | 10.88 |
| 1600 | 17.28 | 16.13 | 15.07 | 14.09 | 13.17 | 12.32 | 11.54 | 10.80 |
| 1600 | 17.14 | 16.01 | 14.95 | 13.98 | 13.07 | 12.23 | 11.45 | 10.72 |
| 1600 | 17.00 | 15.87 | 14.83 | 13.86 | 12.96 | 12.13 | 11.35 | 10.63 |
| 1600 | 16.85 | 15.73 | 14.70 | 13.74 | 12.85 | 12.02 | 11.25 | 10.53 |
| 1600 | 16.68 | 15.58 | 14.55 | 13.60 | 12.72 | 11.90 | 11.14 | 10.43 |
| 1600 | 16.51 | 15.41 | 14.40 | 13.46 | 12.59 | 11.78 | 11.02 | 10.32 |
| 1600 | 16.32 | 15.24 | 14.24 | 13.31 | 12.44 | 11.64 | 10.90 | 10.20 |
| 1600 | 16.12 | 15.05 | 14.06 | 13.14 | 12.29 | 11.50 | 10.76 | 10.08 |
| 1600 | 15.90 | 14.85 | 13.87 | 12.97 | 12.13 | 11.35 | 10.62 | 9.94 |
| 1600 | 15.67 | 14.63 | 13.67 | 12.78 | 11.95 | 11.18 | 10.47 | 9.80 |
| 1600 | 15.43 | 14.41 | 13.46 | 12.58 | 11.76 | 11.01 | 10.30 | 9.65 |
| 1600 | 15.16 | 14.16 | 13.23 | 12.37 | 11.56 | 10.82 | 10.13 | 9.48 |
| 1600 | 14.88 | 13.90 | 12.99 | 12.14 | 11.35 | 10.62 | 9.94 | 9.31 |
| 1600 | 14.59 | 13.62 | 12.72 | 11.89 | 11.12 | 10.41 | 9.74 | 9.12 |
| 1600 | 14.27 | 13.32 | 12.45 | 11.63 | 10.88 | 10.18 | 9.53 | 8.92 |
| 1600 | 13.93 | 13.00 | 12.15 | 11.36 | 10.62 | 9.93 | 9.30 | 8.71 |
| 1600 | 13.56 | 12.66 | 11.83 | 11.06 | 10.34 | 9.68 | 9.06 | 8.48 |
| 1600 | 13.17 | 12.30 | 11.49 | 10.74 | 10.05 | 9.40 | 8.80 | 8.24 |
| 1600 | 12.76 | 11.92 | 11.13 | 10.41 | 9.73 | 9.10 | 8.52 | 7.98 |
| 1600 | 12.32 | 11.51 | 10.75 | 10.05 | 9.40 | 8.79 | 8.23 | 7.71 |
| 1600 | 11.85 | 11.07 | 10.34 | 9.67 | 9.04 | 8.46 | 7.92 | 7.41 |
| 2400 | 26.73 | 24.96 | 23.32 | 21.79 | 20.38 | 19.07 | 17.85 | 16.71 |
| 2400 | 26.59 | 24.83 | 23.19 | 21.68 | 20.27 | 18.97 | 17.75 | 16.63 |
| 2400 | 26.44 | 24.68 | 23.06 | 21.56 | 20.16 | 18.86 | 17.65 | 16.53 |
| 2400 | 26.27 | 24.53 | 22.92 | 21.42 | 20.03 | 18.74 | 17.54 | 16.43 |
| 2400 | 26.10 | 24.37 | 22.77 | 21.28 | 19.90 | 18.62 | 17.43 | 16.32 |
| 2400 | 25.91 | 24.20 | 22.61 | 21.13 | 19.76 | 18.49 | 17.30 | 16.20 |
| 2400 | 25.71 | 24.01 | 22.43 | 20.97 | 19.61 | 18.34 | 17.17 | 16.08 |
| 2400 | 25.50 | 23.81 | 22.25 | 20.79 | 19.44 | 18.19 | 17.03 | 15.94 |
| 2400 | 25.27 | 23.60 | 22.04 | 20.60 | 19.27 | 18.03 | 16.87 | 15.80 |
| 2400 | 25.02 | 23.37 | 21.83 | 20.40 | 19.08 | 17.85 | 16.71 | 15.65 |
| 2400 | 24.76 | 23.12 | 21.60 | 20.19 | 18.88 | 17.66 | 16.53 | 15.48 |
| 2400 | 24.48 | 22.86 | 21.35 | 19.96 | 18.66 | 17.46 | 16.35 | 15.31 |
| 2400 | 24.18 | 22.57 | 21.09 | 19.71 | 18.44 | 17.25 | 16.14 | 15.12 |
| 2400 | 23.85 | 22.27 | 20.81 | 19.45 | 18.19 | 17.02 | 15.93 | 14.92 |
| 2400 | 23.51 | 21.95 | 20.51 | 19.17 | 17.93 | 16.77 | 15.70 | 14.70 |
| 2400 | 23.14 | 21.61 | 20.19 | 18.87 | 17.65 | 16.51 | 15.45 | 14.47 |
| 2400 | 22.75 | 21.24 | 19.84 | 18.55 | 17.35 | 16.23 | 15.19 | 14.22 |
| 2400 | 22.33 | 20.85 | 19.48 | 18.21 | 17.02 | 15.93 | 14.91 | 13.96 |
| 2400 | 21.88 | 20.43 | 19.09 | 17.84 | 16.68 | 15.61 | 14.61 | 13.68 |
| 2400 | 21.40 | 19.98 | 18.67 | 17.45 | 16.32 | 15.27 | 14.29 | 13.38 |
| 2400 | 20.89 | 19.50 | 18.22 | 17.03 | 15.93 | 14.90 | 13.95 | 13.06 |
| 2400 | 20.34 | 19.00 | 17.75 | 16.59 | 15.51 | 14.51 | 13.58 | 12.72 |
| 2400 | 19.76 | 18.45 | 17.24 | 16.11 | 15.07 | 14.10 | 13.20 | 12.36 |
| 2400 | 19.14 | 17.88 | 16.70 | 15.61 | 14.60 | 13.66 | 12.78 | 11.97 |
| 2400 | 18.48 | 17.26 | 16.13 | 15.07 | 14.09 | 13.19 | 12.34 | 11.56 |
| 2400 | 17.78 | 16.60 | 15.51 | 14.50 | 13.56 | 12.69 | 11.87 | 11.12 |

Based on the calculated results, a humidification system according to the present invention was assembled and tested to verify that nitrogen streams having flow rates ranging from 12 to 20 scfh could be accurately humidified to dew points from 7 to 13° C. The system included a 3 gallon bubble-type CM humidifier (with an optional heater) and an EGK ½ sample gas cooler from Buhler Technologies. The system was tested using both heated and unheated water in the humidifier, with water temperatures ranging from 18 to 61° C. Data was collected over 100 hours, for nitrogen flow rates ranging from 12 to 20 scfh and gas cooler settings ranging from 7 to 13° C. In all cases, the system maintained the dew point of the humidified nitrogen stream within +/−0.50° C. Based upon an initial dew point inside the high heat zone of a furnace of −55° C. and a total gas flow ($N_2$+$H_2$) to the furnace of 1750 scfh, it was determined that system as tested would be able to reliably provide a sufficient amount of moisture to raise the dew point within the furnace from −55° C. to the desired dew point of −40° C.

Having described the various aspects of the compositions herein, further specific embodiments of the invention include those set forth in the following lettered paragraphs:

A. A method for providing a humidified gas stream to a point of usage comprising providing a stream of dry gas; directing at least a portion of the dry gas stream to a humidification device; humidifying the at least a portion of the dry gas stream to provide a humidified gas stream having an amount of moisture in excess of a predetermined amount; directing the humidified gas stream to a cooling device; cooling the humidified gas to a predetermined temperature; and directing the cooled humidified gas to the point of usage.

B. The method of paragraph A, wherein the moisture is water vapor and the predetermined amount of moisture is equal to the amount of water vapor required to increase the dew point at the point of usage to a desired dew point.

C. The method of any of paragraphs A and B, wherein the point of usage is a continuous sintering furnace and the desired dew point at the continuous sintering furnace is from about −35 to about −45° F.

D. The method of any of paragraphs A through C, wherein the humidification device humidifies the at least a portion of the dry gas stream by passing the dry gas through a liquid bath.

E. The method of any of paragraphs A through D, wherein the humidification device operates at ambient temperature or pressure or at both ambient temperature and pressure.

F. The method of any of paragraphs A through E, further comprising adding from about 1 to about 15 vol % of a reducing gas to the cooled humidified gas prior to the point of usage.

G. The method of any of paragraphs A through F, wherein the pressure change in pressure across the humidification device is less than about 5 psig, or less than about 3 psig, or less than about 1 psig.

H. A method for providing a humidified gas stream to a point of usage comprising providing a main stream of dry gas; directing a slip stream from the main stream of dry gas to a humidification device; humidifying the slip stream of dry gas to provide a humidified gas stream having an amount of moisture in excess of a predetermined amount; directing the humidified gas stream to a cooling device; cooling the humidified gas to a predetermined cooling temperature; combining the cooled humidified gas with the main stream of dry gas to form a mixed gas stream; and directing the mixed gas stream to the point of usage.

I. The method of paragraph H, wherein the humidification device operates at ambient temperature and pressure.

J. The method of any of paragraphs H and I further comprising determining the pressure at the point of usage and adjusting the pressure of the main stream of dry gas and the pressure of the slip stream to be substantially equivalent to the pressure at the point of usage.

K. The method of any of paragraphs H through J further comprising determining a desired moisture concentration at the point of usage; measuring the actual moisture concentration at the point of usage; adjusting one or both of the flow rate of the slip stream and the cooling temperature based upon the actual moisture concentration at the point of usage; and repeating the preceding two steps as necessary until the desired moisture concentration and the actual moisture concentration are substantially the same.

L. The method of any of paragraphs H through K, wherein the moisture is water vapor and the predetermined amount of moisture is equal to the amount of water vapor required to increase the dew point at the point of usage to a desired dew point.

M. The method of any of paragraphs H through L, wherein the point of usage is a continuous sintering furnace and the desired dew point at the continuous sintering furnace is from about −35 to about −45° F.

N. A method for providing a humidified gas stream to a continuous furnace comprising providing a main stream of dry gas comprising nitrogen and having a flow rate from about 1600 to about 2400 standard cubic feet per hour (scfh); directing a slip stream having a flow rate from about 12 to about 20 scfh from the main stream of dry gas to a humidification device comprising a water bath; humidifying the slip stream of dry gas by passing the dry gas through the water bath to provide a humidified gas stream having an amount of water vapor in excess of the amount of water vapor required to maintain the dew point in the continuous furnace at about −40° C.; directing the humidified gas stream to a cooling device; cooling the humidified gas to a temperature from about 7° C. to about 13° C.; combining the cooled humidified gas with the main stream of dry gas to form a mixed gas stream; and directing the mixed gas stream to the continuous furnace.

O. A system for providing a humidified gas stream to a point of usage comprising a dry gas stream; a humidification device configured to receive at least a portion of the dry gas stream and humidify the at least a portion of the dry gas stream to form a humidified gas stream having an amount of moisture in excess of a predetermined amount; and a cooling device configured to receive the humidified gas stream and cool the humidified gas stream to a predetermined temperature to form a cooled humidified gas stream.

P. The system of paragraph O, wherein the dry gas stream comprises nitrogen.

Q. The system of any of paragraphs O and P, wherein the cooled humidified gas stream provided to the point of usage comprises from about 1 to about 15 vol % of a reducing gas.

R. The system of any of paragraphs O through Q, wherein the cooled humidified gas stream provided to the point of usage comprises nitrogen and from about 1 to about 15 vol % hydrogen.

S. The system of any of paragraphs O through R, wherein the point of usage is a continuous furnace configured to receive the cooled humidified gas stream.

T. The system of any of paragraphs O through S, wherein the point of usage is a continuous sintering furnace and the predetermined amount of moisture is the amount required to maintain the dew point in the continuous sintering furnace at a temperature between about −35 and about −45° F.

U. The system of any of paragraphs O through T, wherein the humidification device is a water bath or bubble humidifier and the cooling device is a sample gas cooler.

Benefits of the systems and methods described herein include, but are not limited to, one or more of the following: operation at ambient pressure and/or temperature, little or no pressure change across the humidification device, ease of installation, no minimum limit on the amount of moisture added, use of cost-effective and/or commercially available humidification and cooling devices, provision of an optimum level of humidification, the ability to hold a dew point constant over a wide range of ambient temperatures, and, in most cases, no heating requirement in the humidifier or gas line. Further, the systems and methods described herein can be separate from and independent of humidification systems used for delubrication, and they do not require incremental atmosphere flows or change the flow balance within a furnace. Finally, humidification systems and methods according to the invention can be easily employed in conjunction with existing gas supply piping to a furnace or other point of usage.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application for all jurisdictions in which such incorporation is permitted.

Certain embodiments and features of the invention have been described using a set of numerical upper limits and a set of numerical lower limits. For the sake of brevity, only certain ranges are explicitly disclosed herein. However, it should be appreciated that ranges from any lower limit to any upper limit are contemplated unless otherwise indicated. Similarly, ranges from any lower limit may be combined with any other lower limit to recite a range not explicitly recited, and ranges from any upper limit may be combined with any other upper limit to recite a range not explicitly recited. Further, a range includes every point or individual value between its end points even though not explicitly recited. Thus, every point or individual value may serve as its own lower or upper limit combined with any other point or individual value or any other lower or upper limit, to recite a range not explicitly recited. All numerical values are "about" or "approximately" the indicated value, and take into account experimental error and variations that would be expected by a person having ordinary skill in the art.

In certain of the following claims, letters are used to identify claimed steps (e.g., a., b., c., etc.). These letters are used to aid in referring to the method steps and are not intended to indicate the order in which the claimed steps are performed, unless and only to the extent that such order is necessary for operability of the invention or specifically recited in the claims.

While the foregoing is directed to embodiments of the invention and alternate embodiments thereof, various changes, modifications, and alterations from the invention may be contemplated by those skilled in the art without departing from the intended spirit and scope thereof. It is intended that the present invention only be limited by the terms of the appended claims.

The invention claimed is:

1. A method for humidifying an atmosphere inside a furnace by providing a humidified gas stream comprising:

a. providing a stream of dry gas;

b. directing at least a portion of the dry gas stream to a humidification device;

c. humidifying the at least a portion of the dry gas stream to provide a humidified gas stream having an amount of moisture in excess of a predetermined amount;

d. directing the humidified gas stream to a cooling device;

e. cooling the humidified gas stream to a predetermined temperature; and f. directing the cooled humidified gas stream to the furnace.

2. The method of claim 1, wherein step c. further comprises providing water as a source of moisture and humidifying the at least a portion of the dry gas stream with the water to produce a concentration of water vapor in the humidified gas stream in excess of the amount of water vapor required to increase the dew point inside the furnace to a desired dew point.

3. The method of claim 2, wherein step f. further comprises directing the cooled humidified gas stream to a continuous sintering furnace and step e. further comprises measuring the moisture concentration in the continuous sintering furnace and cooling the humidified gas stream to a temperature which maintains a dew point in the continuous sintering furnace is from about −35 to about −45° F.

4. The method of claim 2, wherein step c. further comprises humidifying the at least a portion of the dry gas stream by passing the dry gas through a liquid bath.

5. The method of claim 1, wherein step c. further comprises humidifying the at least a portion of the dry as stream at ambient temperature and a pressure that is less than 3 psig.

6. A system for providing a humidified gas stream to a furnace comprising:

a dry gas stream;

a humidification device configured to receive at least a portion of the dry gas stream and humidify the at least a portion of the dry gas stream to form a humidified gas stream having an amount of moisture in excess of a predetermined amount; and a cooling device configured to receive the humidified gas stream and cool the humidified gas stream to a predetermined temperature to form a cooled humidified gas stream;

wherein the humidification device is configured to operate at ambient temperature and a pressure that is less than 3 psig.

7. The system of claim 6, wherein the dry gas stream comprises nitrogen which is directed through a gas containing conduit to the humidification device.

8. The system of claim 6, wherein the furnace is a continuous furnace configured to receive the cooled humidified gas stream through the gas containing conduit from the cooling device and further comprising a measurement device for measuring the moisture concentration in the furnace.

9. The system of claim 8, wherein the humidification device is a water bath or bubble humidifier operating at ambient temperature and the cooling device is a sample gas cooler.

10. A method for providing a desired moisture concentration in a furnace, the method comprising:

a. selecting at least one of a predetermined temperature and a first flow rate as a function of a measured moisture concentration in the furnace and a desired moisture concentration in the furnace;

b. providing a stream of dry gas;

c. directing at least a portion of the dry gas stream to a humidification device;

d. humidifying the at least a portion of the dry gas stream to provide a humidified gas stream having an amount of moisture in excess of a predetermined amount;

e. directing the humidified gas stream to a cooling device;

f. cooling the humidified gas to the predetermined temperature to create a cooled humidified gas stream; and g. directing the cooled humidified gas stream into the furnace at the first flow rate.

11. The method of claim 10, further comprising:

h. adjusting at least one of the predetermined temperature and the first flow rate until a difference between the measured moisture concentration and the desired moisture concentration is within a predetermined amount.

12. The method of claim 11, wherein the predetermined amount is 5%.

13. The method of claim 11, wherein the measured moisture concentration comprises a dew point in the furnace.

* * * * *